US011155385B2

(12) United States Patent
Robertaccio

(10) Patent No.: US 11,155,385 B2
(45) Date of Patent: Oct. 26, 2021

(54) CONTAINER HOLDER

(71) Applicant: Michael Robertaccio, Mechanicville, NY (US)

(72) Inventor: Michael Robertaccio, Mechanicville, NY (US)

( * ) Notice: Subject to any disclaimer, the term of this patent is extended or adjusted under 35 U.S.C. 154(b) by 0 days.

(21) Appl. No.: 15/905,169

(22) Filed: Feb. 26, 2018

(65) Prior Publication Data

US 2019/0263564 A1 Aug. 29, 2019

(51) Int. Cl.
*B65D 25/10* (2006.01)
*B65D 81/38* (2006.01)
*B65D 21/02* (2006.01)

(52) U.S. Cl.
CPC ..... *B65D 25/10* (2013.01); *B65D 21/0209* (2013.01); *B65D 81/3876* (2013.01)

(58) Field of Classification Search
CPC .... B65D 25/10; B65D 25/101; B65D 25/107; B65D 81/3876; B65D 21/0209
USPC .. 220/739, 737, 740, 592.17, 592.2, 592.25; 206/430, 427
See application file for complete search history.

(56) References Cited

U.S. PATENT DOCUMENTS 4,534,391 A * 8/1985 Ventimiglia ..... A47G 23/0266 220/739
5,060,899 A * 10/1991 Lorence ..... B60N 3/102 248/311.2
5,467,891 A * 11/1995 Perry ..... B65D 81/3886 220/739
5,860,559 A * 1/1999 Wang ..... A47G 23/0208 220/632
6,626,326 B2 * 9/2003 Murakami ..... B65D 81/3881 220/23.87
7,337,915 B1 * 3/2008 Weldon ..... A47G 23/0225 220/483
7,419,320 B2 * 9/2008 LaBrasca ..... A45C 11/34 206/1.7
7,731,144 B2 * 6/2010 Kazyaka ..... B60N 3/107 248/311.2
8,448,810 B2 * 5/2013 Kelly ..... A47J 41/0077 220/592.27
8,870,044 B1 * 10/2014 Freese ..... F16B 2/12 224/407
9,238,542 B2 * 1/2016 Bollis ..... B65D 81/3879
2004/0084461 A1 * 5/2004 Eisenbraun ..... B60N 3/103 220/739
2005/0230586 A1 * 10/2005 Gary ..... B65D 21/0224 248/311.2
2008/0011925 A1 * 1/2008 Ruff ..... B60N 3/103 248/310

(Continued)

*Primary Examiner* — Steven A. Reynolds
(74) *Attorney, Agent, or Firm* — Schmeiser, Olsen & Watts, LLP

(57) ABSTRACT

A container holder including a body portion having a first end, a second end, an inner surface, and an outer surface, wherein an interior region of the body portion is defined as a generally axial opening between the first end and the second end, and at least one retaining element disposed along the inner surface of the body portion, wherein a container is received within the generally axially opening of the body portion, and the at least one retaining element exerts a force against the container to retain the container within the generally axial opening. Furthermore, an associated method is also provided.

17 Claims, 15 Drawing Sheets

(56) References Cited

U.S. PATENT DOCUMENTS

| | | | | |
|---|---|---|---|---|
| 2015/0342382 | A1* | 12/2015 | D'Alesio | A47G 23/0216 220/739 |
| 2016/0150902 | A1* | 6/2016 | Dokhanian | A47G 23/0241 220/739 |

* cited by examiner

CONTAINER HOLDER

FIELD OF TECHNOLOGY

The following relates to a container holder and more specifically to embodiments of a container holder that secures the container within the holder and audibly alerts a user to a limit of insertion of the container within the container holder.

BACKGROUND

Contents in a container may be intended to be consumed or used warm, cold, or room temperature. To keep a user's hand from becoming cold or warm while holding the container with contents, and to limit the effects of a user holding the contents on a temperature of the contents, a sleeve may be placed around the beverage container. Current sleeves do not properly secure the container within the sleeve.

Thus, a need exists for an apparatus and method for a container holder that securely receives a container.

SUMMARY

A first aspect relates generally to a container holder comprising: a body portion having a first end, a second end, an inner surface, and an outer surface, wherein an interior region of the body portion is defined as a generally axial opening between the first end and the second end, and at least one retaining element disposed along the inner surface of the body portion, wherein a container is received within the generally axially opening of the body portion, and the at least one retaining element exerts a force against the container to retain the container within the generally axial opening.

A second aspect relates generally to an apparatus comprising: a first beverage container holder comprising a first cylindrical body portion having a first end, a second end, an inner surface, and an outer surface, wherein an interior region of the first cylindrical body portion is defined as a generally axial opening between the first end and the second end, and at least one retaining element disposed along the inner surface of the first cylindrical body portion, wherein the at least one retaining element is located proximate a bottom surface of the first cylindrical body portion, and a second beverage container holder invertedly attached to the first beverage container holder, the second beverage container holder comprising a second cylindrical body portion having a first end, a second end, an inner surface, and an outer surface, wherein an interior region of the second cylindrical body portion is defined as a generally axial opening between the first end and the second end, and at least one retaining element disposed along the inner surface of the second cylindrical body portion, wherein the at least one retaining element is located proximate a bottom surface of the second cylindrical body portion.

A third aspect relates generally to a method for securely retaining a container within a thermally insulated holder, comprising: disposing at least one retaining element along an inner surface of a body portion, wherein a location of the at least one retaining element with respect to a bottom surface creates a sound effect when a container moves from an initial contact with the at least one retaining element to a final, retained position of engagement.

A fourth aspect relates generally to a method of simultaneously thermally insulating a beverage and retaining the beverage.

A fifth aspect relates generally to a beverage container holder capable of thermally insulating a beverage and retaining a beverage.

A sixth aspect relates generally to a beverage container holder that can securely retain different sized beverage containers.

The foregoing and other features of construction and operation will be more readily understood and fully appreciated from the following detailed disclosure, taken in conjunction with accompanying drawings.

BRIEF DESCRIPTION OF THE DRAWINGS

Some of the embodiments will be described in detail, with reference to the following figures, wherein like designations denote like members, wherein.

DETAILED DESCRIPTION

A detailed description of the hereinafter described embodiments of the disclosed apparatus and method are presented herein by way of exemplification and not limitation with reference to the Figures. Although certain embodiments are shown and described in detail, it should be understood that various changes and modifications may be made without departing from the scope of the appended claims. The scope of the present disclosure will in no way be limited to the number of constituting components, the materials thereof, the shapes thereof, the relative arrangement thereof, etc., and are disclosed simply as an example of embodiments of the present disclosure.

As a preface to the detailed description, it should be noted that, as used in this specification and the appended claims, the singular forms "a", "an" and "the" include plural referents, unless the context clearly dictates otherwise.

Figure 1:
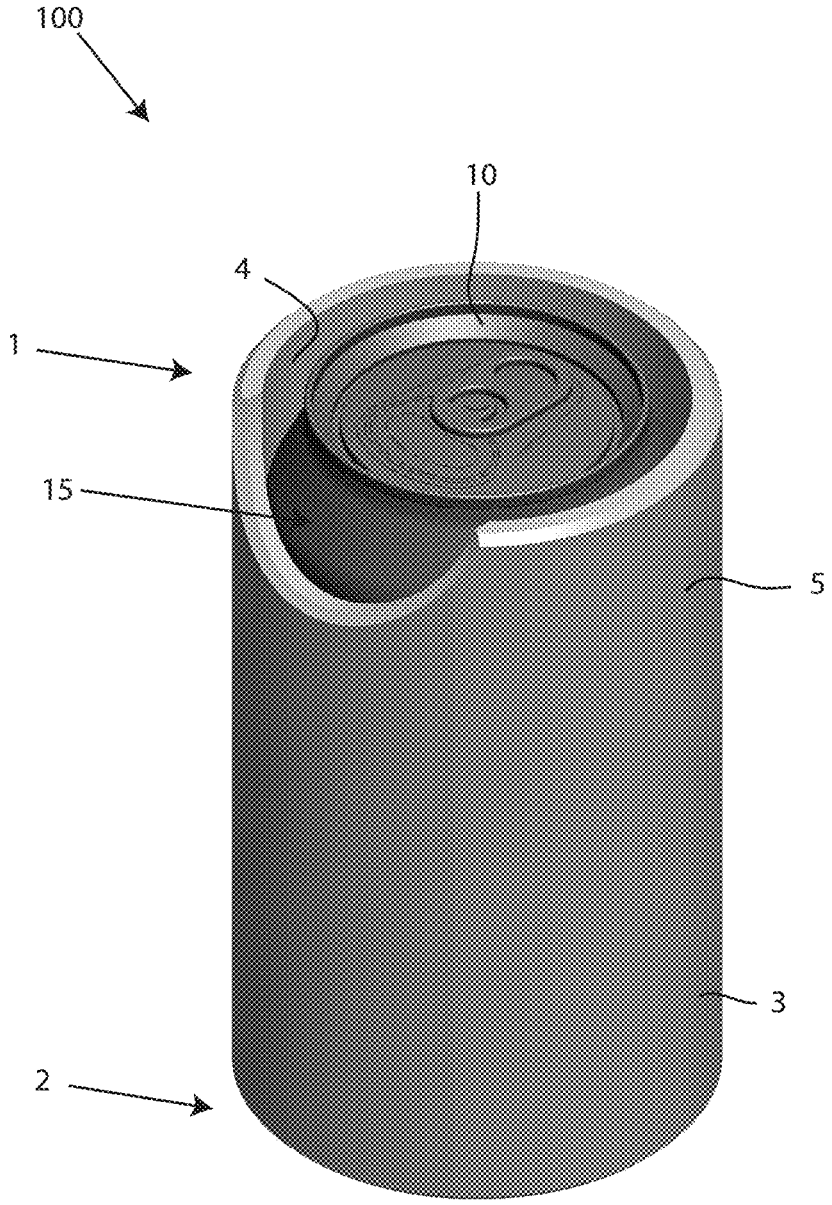
FIG. 1 depicts a perspective view of a container holder, in accordance with embodiments of the present invention.

Referring to the drawings, FIG. 1 depicts a perspective view of a container holder 100, in accordance with embodiments of the present invention. Embodiments of the container holder 100 may be a holder, a beverage container holder, a container holder, a beverage holder, a can holder, a drink holder, a bottle holder, a glass holder, a cup holder, a bowl holder, a drink sleeve, a bottle sleeve, a can sleeve, a beverage container sleeve, a contents sleeve, a snap-fit container holder, a snap-fit jacket, a beverage container receptacle, an insulated holder, a receptacle, a sleeve, cover, an insulator, a jacket, and the like. Embodiments of the container holder 100 may be configured to accept, receive, accommodate, surround, insulate, secure, cover, etc. a container 10. For example, a container 10 may be inserted within an interior of the container holder 100. A container 10 may be a beverage container. Embodiments of the beverage container may be a bottle, an aluminum can, a metal can, a metal bottle, a glass bottle, a beer bottle, a beer can, a soda can, a soda bottle, an energy drink can, or any container, vessel, bottle, can, etc. that may hold a liquid for consumption by a user. In exemplary embodiments, the container 10 may be a container, bottle, receptacle, vessel, can, canister, carton, and the like, configured to hold or otherwise retain contents. The contents retained in the container 10 may be solids, liquids, gases, food, water, alcohol, soup, coffee, beer, juice, tea, bait, insects, temperature-sensitive contents, and the like, or any contents that may benefit from an insulated layer surrounding the contents. Embodiments of the container 10 may be cylindrical and have varying heights and/or varying volume capacity. For instance, embodiments of the beverage container 10 may have an 8 oz capacity, a 10 oz capacity, 12 oz capacity, a 15 oz capacity, a 16 oz capacity, a 23 oz capacity, and the like. Further, embodiments of the container 10 may have various cross-sections, such as square, rectangular, curvilinear, or otherwise polygonal.

Figure 2:
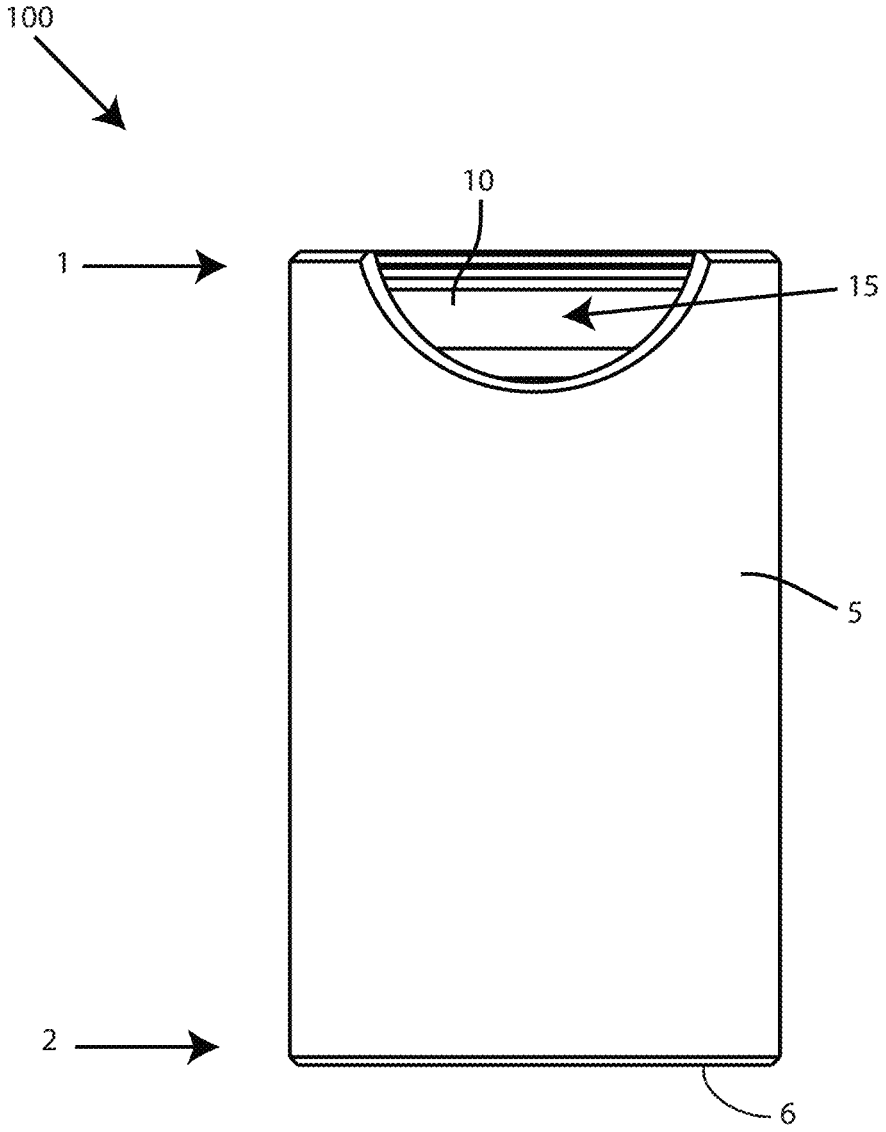
FIG. 2, which depicts a front view of the container holder, in accordance with embodiments of the present invention.

With additional reference to FIG. 2, which depicts a front view of the container holder 100, in accordance with embodiments of the present invention, embodiments of the container holder 100 may include a first end 1, a second end 2, an outer surface 3, and an outer surface 4. Embodiments of the container holder 100 may have a generally axial opening extending from the first end 1 to the second end 2. The generally axial opening may be an interior region or space for receiving the container 10. Embodiments of the container holder 100 may further include a bottom surface 6 at the second end 2, wherein the first end 1 may be open for initially receiving the container 10. Furthermore, embodiments of the container holder 100 may include a body portion 5. Embodiments of the body portion 5 may form one or more walls of the container holder 100. In an exemplary embodiment, the container holder 100 (e.g. body portion 5) may be cylindrical, wherein a diameter of the axial opening of the container holder 100 may correspond to a diameter of the container 10. The diameter of the top end opening of the body portion 5 may correspond to the diameter of the container 10 such that the diameter of the top end of the body portion 5 may be slightly larger than the diameter of the container 10 to receive the container 10.

Moreover, embodiments of the container holder 100 may be comprised of thermally insulating material. For example, the body portion 5 may be comprised of a thermally insulating material, such as polystyrene, wood, fiberglass, and the like. In other embodiments, the body portion 5 may be comprised of a plastic material, which may still perform thermal insulating characteristics, as well as provide a surface for the user to grip other than a surface of the container 10. Further still, embodiments of the body 5 of the container holder 100 may include a double wall vacuum structure to provide a thermally insulating barrier surrounding the container 10.

In some embodiments, the container holder 100 may include a cutout portion 15. Embodiments of the cutout portion 15 may be a recessed portion, a removed portion, a mouth accommodating portion, a dipped section, a removed section, and the like, which may provide easier access to the contents, such as a drinking opening of the container 10, an opened lid area of the container, and the like. In other words, the body portion 5 may have a section of the body portion 5 notched out, cutout, or otherwise removed proximate the first end 1 of the container holder 100. Thus, a top surface of the body portion 5 may extend circumferentially but dip down a distance and return upwards to define the cutout portion 15. In an operable configuration of an exemplary embodiment, the spout or drinking opening of the container 10, such as a beverage container, may be aligned with the cutout portion 15.

Figure 3:
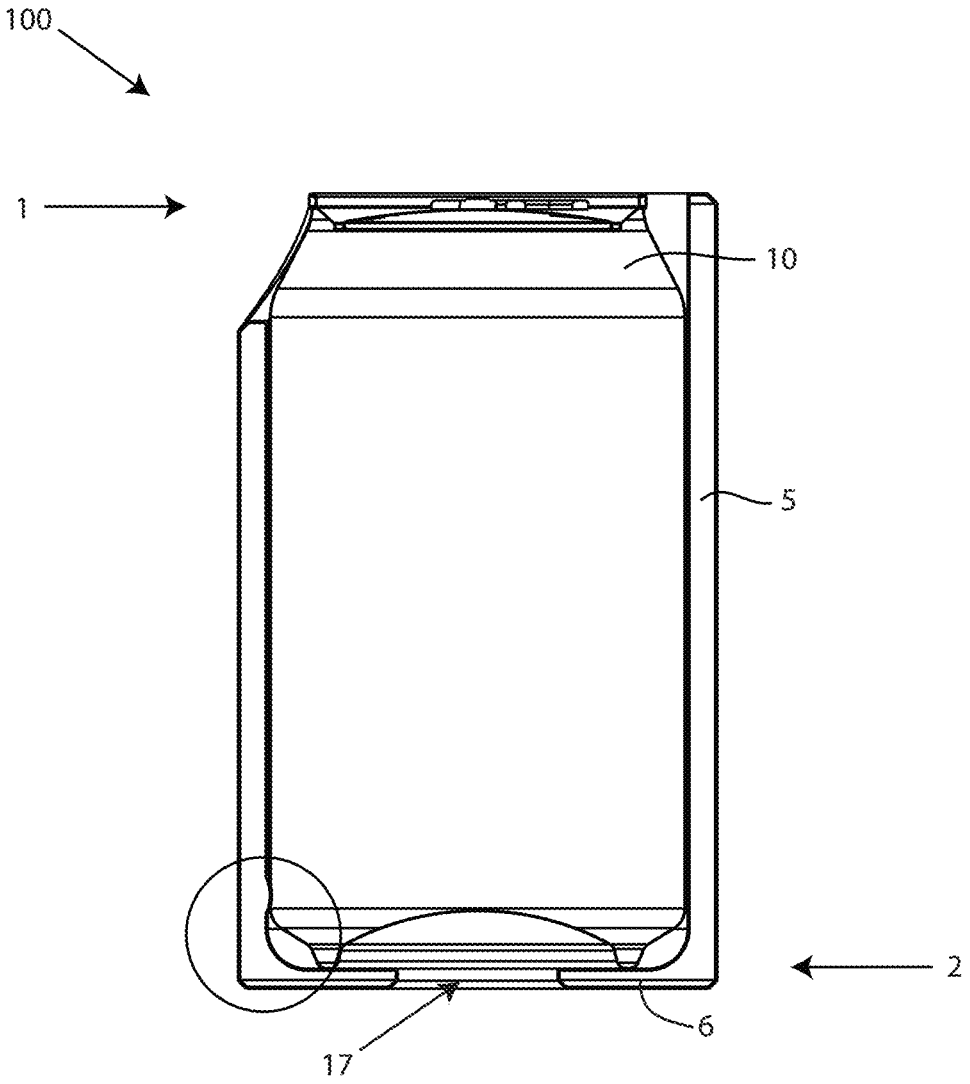
FIG. 3 depicts a cross-section view of the container holder securely retaining a container in an operable configuration, in accordance with embodiments of the present invention.

FIG. 3 depicts a cross-section view of the container holder 100 securely retaining a container in an operable configuration, in accordance with embodiments of the present invention. The container 10 may be inserted within the container holder 100 until the container contacts a bottom surface. In the operable configuration shown in FIG. 3, the side wall of the container 10 may contact (e.g. continuous or intermittent) the inner surface 4 of the body portion 5. However, the container 10 may be securely retained within the body portion 5 using one or more retaining elements 20. Embodiments of the one or more retaining elements 20 may be a bump, a protrusion, a mound, a bulge, a bulged portion, a retainer, extension, and the like. For instance, embodiments of a retaining element may be a portion or section of the inner surface 4 of the body portion 5 that extends/protrudes a distance from the rest of the inner surface 4 of the body portion 5 in a radially inward direction, or otherwise inward direction towards a central axis or center of an interior region of the body portion 5.

Figure 4:
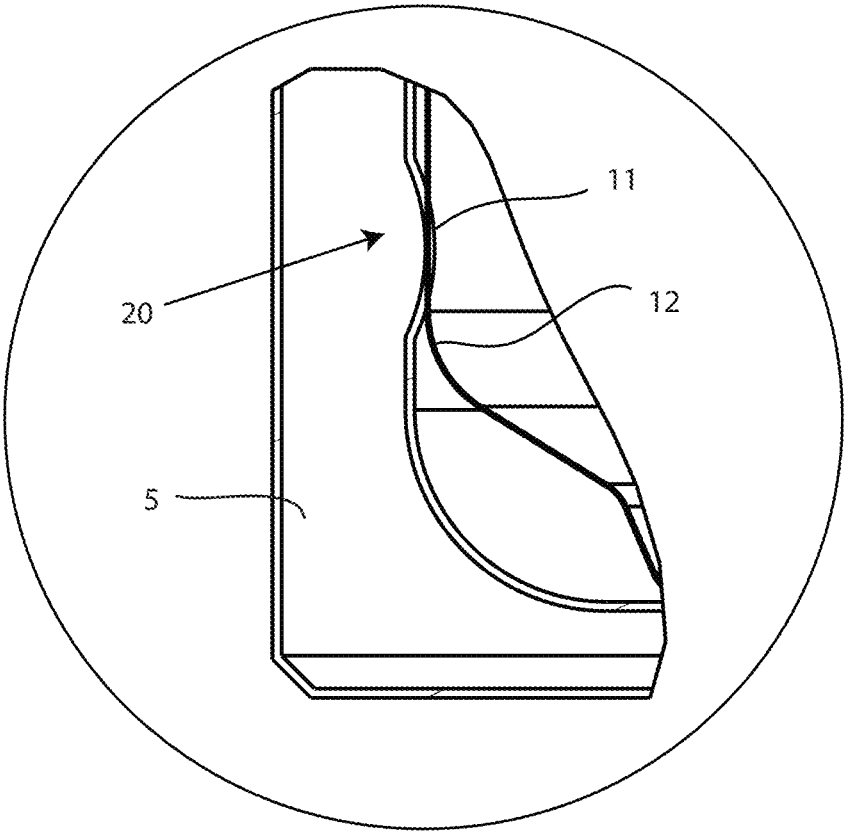
FIG. 4 depicts a detailed section view of FIG. 3, in accordance with embodiments of the present invention.

FIG. 4 depicts a detailed section view of FIG. 3, in accordance with embodiments of the present invention. The retaining element 20 shown in FIG. 3 may protrude a distance from the rest of the inner surface 4 of the body portion 5, such that when the container 10 is slid within the interior region of the container holder 100, a rigid portion 12 of the container 10 may engage the retaining element 20. Embodiments of the rigid portion 12 of the container 10 may be a rounded corner of a beverage container proximate a bottom end of the beverage container. During an initial contact between the retaining element 20 and the rigid portion 12 of the container 10, a movement of the container 10 towards a bottom surface 6 may be hindered. The hindrance may be noticed and/or perceived by the user, which alerts the user that the rigid portion 12 of the container 10 has reached the retaining element 20. The container 10 may be progressed past the retaining element 20 with an additional external force (e.g. minimal amount of additional force) until the bottom edge of the container 10 makes contact with the bottom surface 6 of the container holder 100. In this position, the top surface/top edge of the container 10 may be flush or substantially flush or coplanar with a top edge/top surface of the container holder 100.

Furthermore, embodiments of the top edge/top surface of the container 10 may be brought into contact with the bottom surface 6 of the container holder 100. The container holder 100 may be inverted, and slipped over the container 10, such that the top end of the container 10 may enter the interior region of the container holder 100 prior to the bottom end. As an example, a container 10 may be placed on a table, and a holder 100 may be placed over the container 10. Additionally, contents of the container 10 could be consumed through the opening 17 of the container holder 100, which would now be facing upwards.

Figure 5:
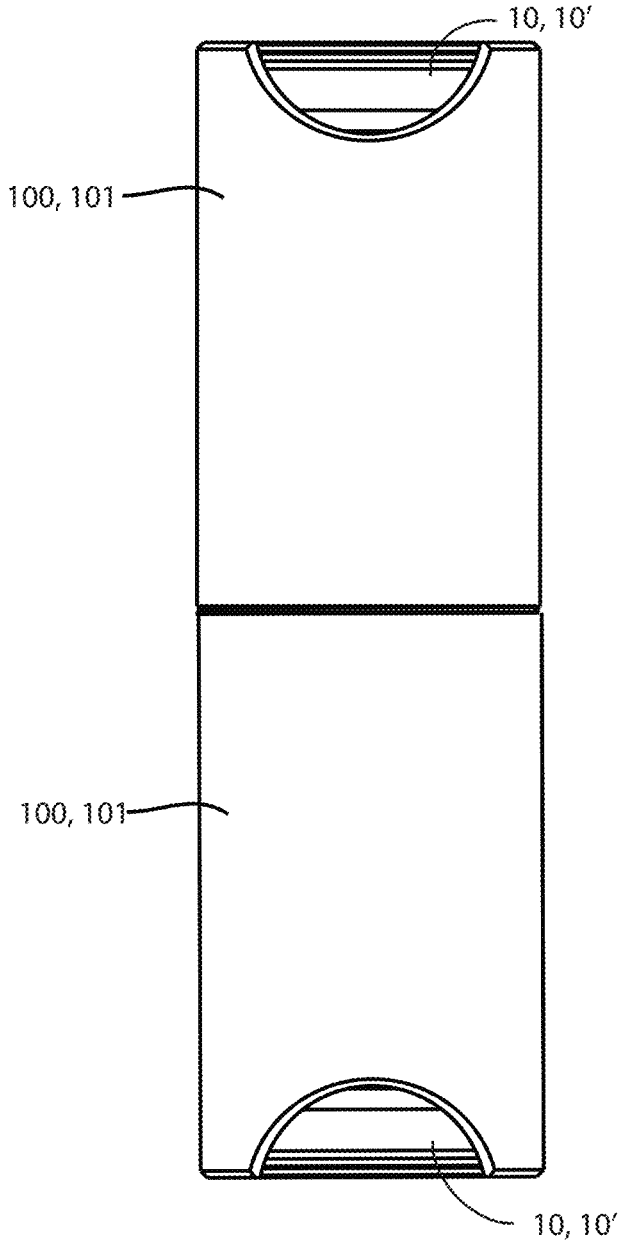
FIG. 5 depicts two container holders stacked together, wherein one of the container holders is inverted, in accordance with embodiments of the present invention.

In the operable configuration shown in FIGS. 3-4, where the bottom edge of the container 10 makes contact with or is proximate the bottom surface 6, the retaining element 20 may be exerting a force against a portion 11 of the side wall of the container 10. The mechanical interference between the retaining element 20 and the portion 11 may be sufficient enough to securely retain the container 10 within the container holder 100. For example, the mechanical interference/engagement between the retaining element 20 and the portion 11 of the container 10 may be substantial enough to counteract a gravitational force if the container holder 100 is inverted. Without the retaining element 20, if the container holder 100 is inverted, the container 10 would slip out of the container holder 100. FIG. 5 depicts two container holders 100 stacked together, wherein one of the container holders 100 is inverted, in accordance with embodiments of the present invention. In this embodiment, a container holder 100 may be adhered, fastened, or otherwise attached to another container holder 100, which is inverted. Alternatively, the container holders 100 may not be attached to each other, and the user may grip both of the container holders 100 to keep them together. Nevertheless, the container 10 in a bottom container holder 100 may be safely retained within the container holder 100 due to at least one retaining element 20 located along the inner surface of the container holder 100. In an exemplary embodiment, the stacked configuration of the container holders 100 may permit portability of more than a single container, wherein an unopened container may be securely retained as the user is mobile and consuming contents of the open container 10 residing within the top container holder 100.

Furthermore, the insertion and/or movement of the container 10 from the initial contact between the rigid portion 12 of the container 10 and the retaining element to a final position (e.g. bottom surface of container 10 contacting the bottom surface 6) may result in a snapping sound. In other words, the container 10 may be snap-fit into the container holder 100. The snapping sound may be the result of the bottom edge/surface of the container 10 making physical contact with the bottom surface 6. However, the snapping effect may be attributable to the added required force to overcome or otherwise advance past the retaining element 20, which results in a greater impact between the container bottom and the bottom surface 6. Further, a location of the retaining element 20 close to the bottom surface reduces a distance that the container 10 needs to travel before making impact with the bottom surface 6. Thus, a combination of the added force to advance beyond the retaining element 20 and the short distance between the retaining element 20 and the bottom surface 6 may result in a "snap" or "pop" sound. The "snap" or "pop" sound may audibly alert the user that the container 10 has reached a final position, and may be safely retained and/or secured within the container holder 100. Further, a location of the retaining element 20 close to a top surface or a center section of the container 10 may also produce a "snap" or "pop" sound. The added force to advance beyond the retaining element 20 and the distance between the retaining element 20 and the bottom surface 6 may result in a "snap" or "pop" sound, which may audibly alert the user that the container 10 has reached a final position, and may be safely retained and/or secured within the container holder 100.

Figure 6:
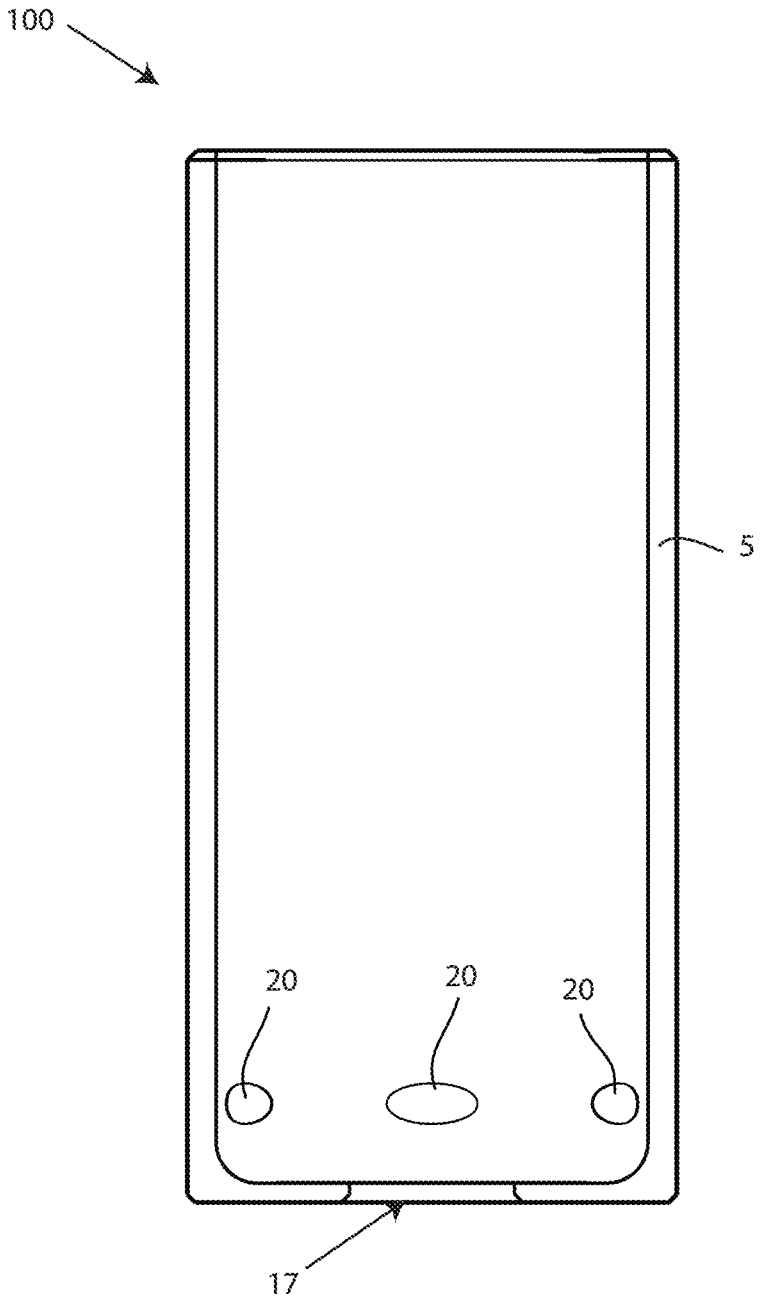
FIG. 6 depicts a cross-section view of the container holder having one or more retaining elements, in accordance with embodiments of the present invention.

Embodiments of the container holder 100 may include a single retaining element 20, or may be a plurality of retaining elements 20. FIG. 6 depicts a cross-section view of the container holder 100 having one or more retaining elements 20, in accordance with embodiments of the present invention. In an exemplary embodiment, the retaining elements 20 may be circumferentially disposed along an inner surface 4 of the container holder 100. For instance, embodiments of the retaining elements 20 may be disposed at various circumferential locations around the body portion 5, yet may share a same axial distance from the bottom surface 6. In alternative embodiments, the retaining element 20 may be a single protrusion that extends continuously across an inner circumference of the body portion 5. Likewise, the retaining element/elements 20 may be disposed at any distance close to the bottom surface 6, at any distance close to the top surface, or anywhere in-between.

Moreover, embodiments of the container holder 100 may include an opening 17. Embodiments of the opening 17 may be an opening, a hole, a bore, a slit, an aperture, an access opening, an access point, and the like. The opening 17 may provide access to the interior region of the container holder 100 from the second end 2 or underneath the bottom surface 6. The access may be useful for dislodging, disengaging, or otherwise removing the container 10 from a retained position within the container holder 100. For instance, a user may insert a finger or other elongated object through the opening 17 to engage the container 10 with enough force to advance the container 10 towards the first end 1 and disengage the mechanical interference between the retaining element 20 and the portion 11 of the beverage container. The opening 17 may also serve additional purposes. For instance, embodiments of the opening 17 may facilitate the attachment of accessories to the holder 100 or to the edges of the opening 17. In an exemplary embodiment, a spike for sticking the container holder 100 in the ground may utilize opening 17, or a spike that faces into the container 10 for puncturing the bottom of the container 10 may utilize opening 17.

Figure 7:
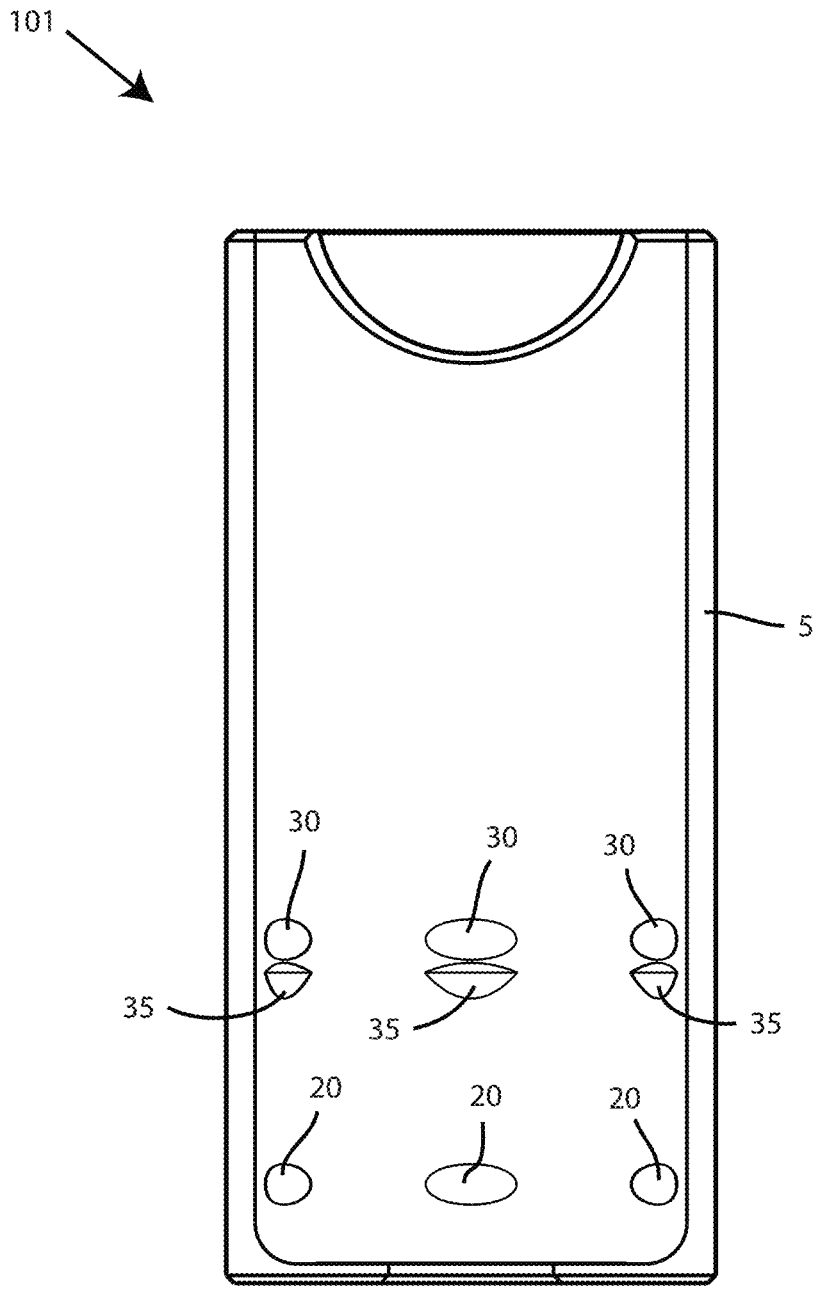
FIG. 7 depicts a cross-section view of a container holder having additional retaining structure, in accordance with embodiments of the present invention.
Figure 8:
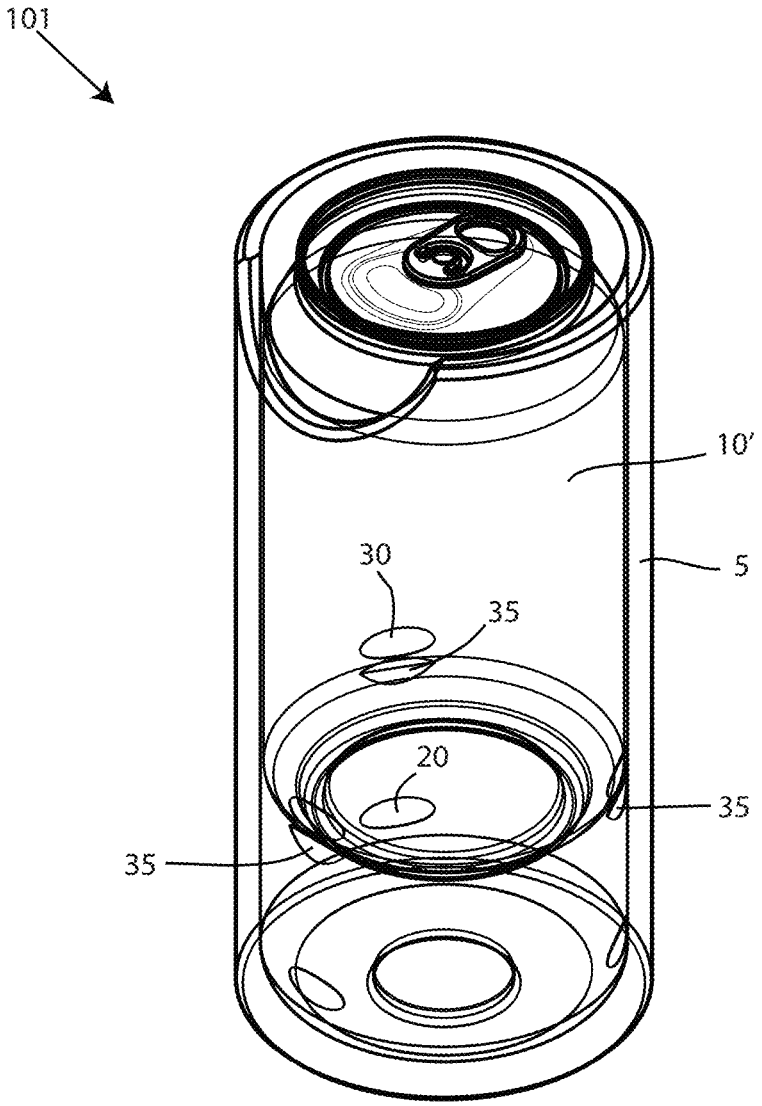
FIG. 8 depicts a perspective, hidden view of a container holder having additional retaining structure and retaining a container, in accordance with embodiments of the present invention.
Figure 9:
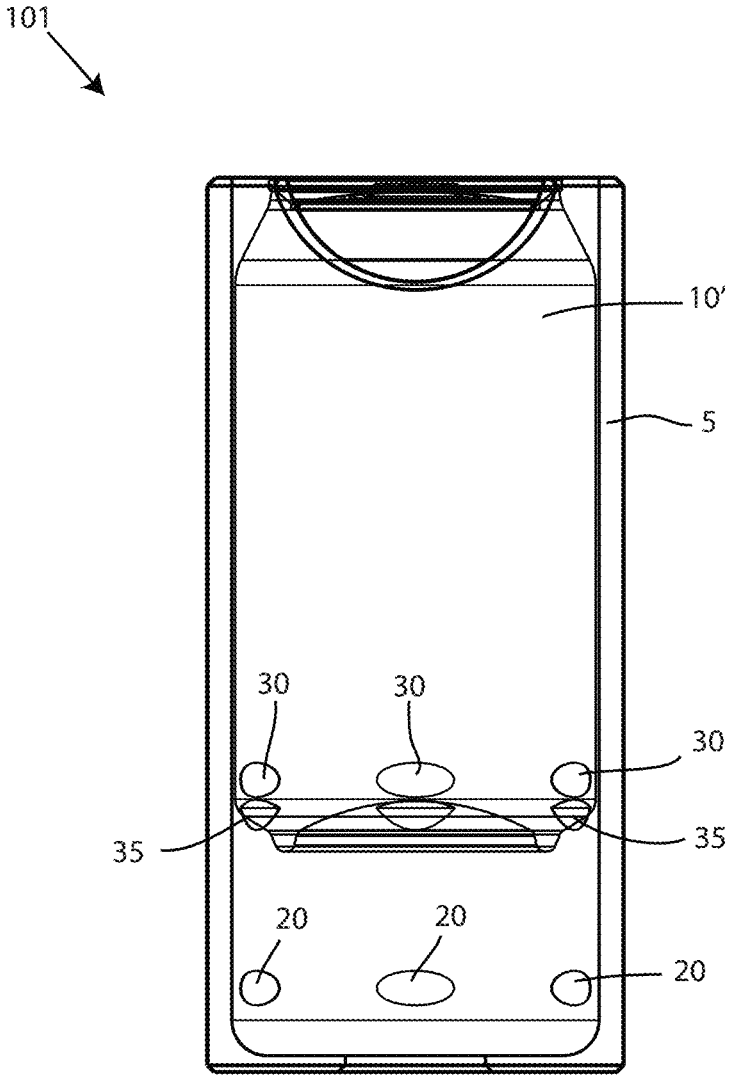
FIG. 9 depicts a cross-section view of a container holder having additional retaining structure and retaining a container, in accordance with embodiments of the present invention.

Referring still to the drawings, FIG. 7 depicts a cross-section view of a container holder 101 having additional retaining structure 30, 35, in accordance with embodiments of the present invention. Embodiments of the container holder 101 may share the same or substantially the same structure and/or function as the container holder 100. For instance, embodiments of the container holder 101 may include a first end 1, a second end 2, an outer surface 3, an inner surface 4, and one or more retaining elements 20. However, embodiments of the container holder 101 may also include an additional retaining structure 30, 35 for accommodating a smaller sized container 10', as shown in FIGS. 8-9. The additional structure 30, 35 may be disposed above the retaining elements 20 (e.g. closer to the first end 1 in an axial direction than the retaining elements 20). Further, the additional retaining structure 30, 35 may include a single retaining structure, or may be a plurality of retaining structures. In an exemplary embodiment, the additional retaining structure 30, 35 may be circumferentially disposed along an inner surface 4 of the container holder 101. For instance, embodiments of the additional retaining structure 30, 35 may be disposed at various circumferential locations around the body portion 5, yet may share a same axial distance from the bottom surface 6.

Embodiments of the additional retaining structure of the container holder 101 may include a retaining element 30 and a step 35. Embodiments of the retaining element 30 may be a bump, a protrusion, a mound, a bulge, a bulged portion, a retainer, an extension, and the like. For instance, embodiments of a retaining element 30 may be a portion or section of the inner surface 4 of the body portion 5 that extends/protrudes a distance from the inner surface 4 of the body portion 5 in a radially inward direction, or otherwise inward direction towards a central axis or central region of an interior region of the body portion 5. Embodiments of the step 35 may be a lip, ledge, shelf, step, rest, or similar surface that may be configured to accommodate a container 10' in a final, retained/secured position. The step 35 may also protrude or otherwise extend a distance from the inner surface 4 to engage the container 10'. Further, embodiments of the step 35 may also be a bump, a protrusion, a mound, a bulge, a bulged portion, a retainer, an extension, and the like, which may have a sharper angled surface so as to form a step or shelf to support the container 10' within the container holder 101.

Figure 10:
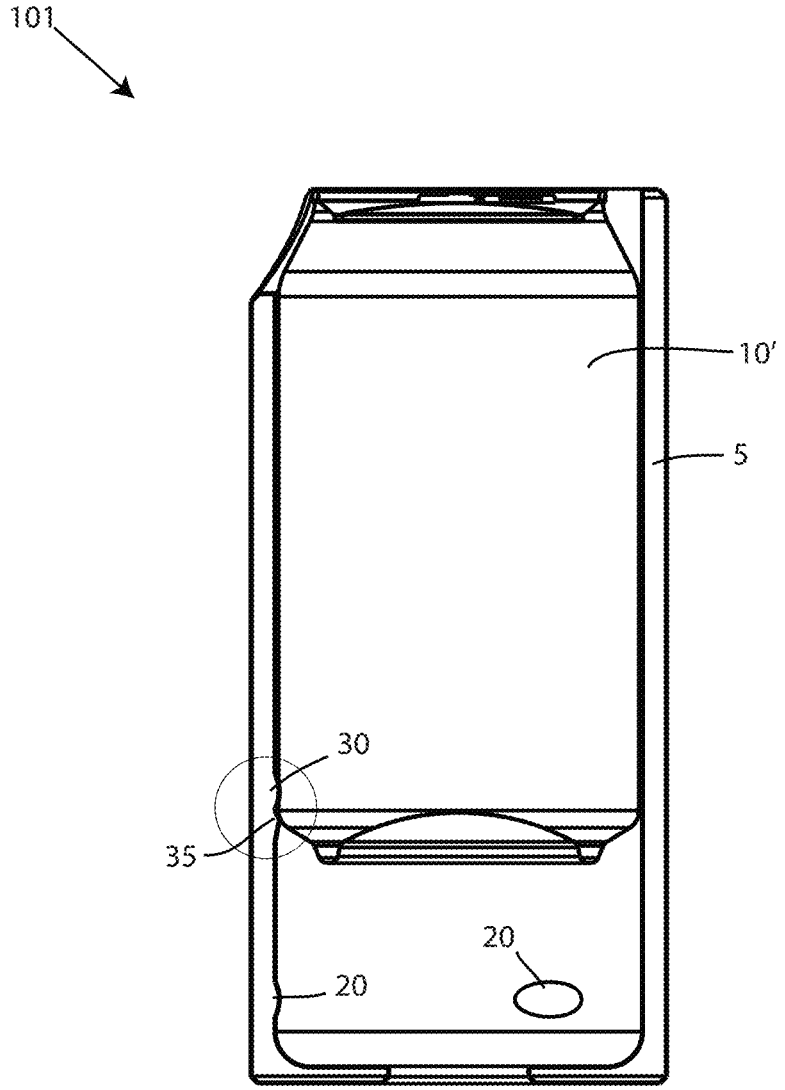
FIG. 10 depicts a cross-section view of a container holder securely retaining a smaller container in an operable configuration, in accordance with embodiments of the present invention.
Figure 11:
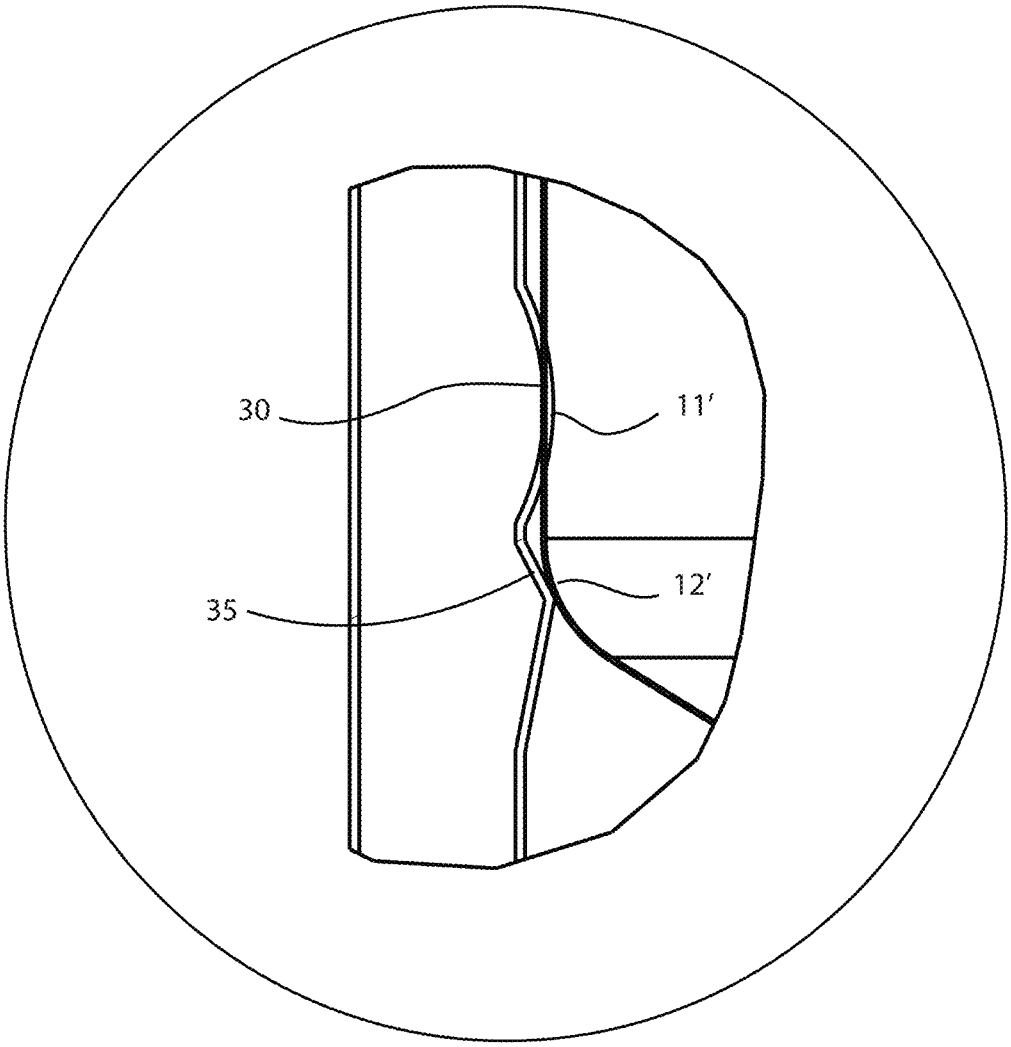
FIG. 11 depicts a detailed section view of FIG. 10, in accordance with embodiments of the present invention.

FIG. 10 depicts a cross-section view of the container holder 101 securely retaining a container 10' in an operable configuration, in accordance with embodiments of the present invention. The container 10' may be inserted within the container holder 101 until the container contacts at least one step 35. In the operable configuration shown in FIG. 10, the side wall of the container 10' may contact (e.g. continuous or intermittent) the inner surface 4 of the body portion 5. However, the container 10' may be securely retained within the body portion 5 using one or more retaining elements 30 and steps 35. FIG. 11 depicts a detailed section view of FIG. 10, in accordance with embodiments of the present invention. The retaining element 30 shown in FIG. 11 may protrude a distance from the inner surface 4 of the body portion 5, such that when the container 10' is slid within the interior region of the container holder 101, a rigid portion 12 of the container 100 may engage the retaining element 30. Embodiments of the rigid portion 12 of the container 10' may be a rounded corner of a beverage container proximate a bottom end of the beverage container. During an initial contact between the retaining element 30 and the rigid portion 12 of the container 10', a movement of the container 10' towards a bottom surface 6 may be hindered. The hindrance may be noticed and/or perceived by the user, which alerts the user that the rigid portion 12 of the container 10' has reached the retaining element 30. The container 10' may be progressed past the retaining element 30 with an additional external force (e.g. minimal amount of additional force) until the rigid portion 12 or the bottom edge of the container 10' makes contact with the step 35 of the container holder 101. In this position, the top surface/top edge of the container 101 may be flush or substantially flush or coplanar with a top edge/top surface of the container holder 101, and a space or void may exist between the bottom edge of the container 10' and the bottom surface 6.

In the operable configuration shown in FIGS. 10-11, where the bottom edge of the container 10' makes contact with the step 35, the retaining element 30 and potentially the step 35 may be exerting a force against a portion 11' of the side wall of the container 10' and the rigid portion 12', respectively. The mechanical interference between the retaining element 30 and the portion 11' and/or the mechanical interface between the step 35 and the rigid portion 12' may be sufficient enough to securely retain the container 10' within the container holder 101. For example, the mechanical interference/engagement between the retaining element 30 and the portion 11' of the container 10 and/or between the step 35 and the rigid portion 12' may be substantial enough to counteract a gravitational force if the container holder 101 is inverted, as shown in FIG. 5.

Furthermore, the insertion and/or movement of the container 10' from the initial contact between the rigid portion 12 of the container 10 and the retaining element to a final position (e.g. bottom surface of container 10' contacting step 35) may result in a snapping sound. In other words, the container 10' may be snap-fit into the container holder 101. The snapping sound may be the result of the bottom edge/surface of the container 101 making physical contact with the step 35. However, the snapping effect may be attributable to the added required force to overcome or otherwise advance past the retaining element 30, which results in a greater impact between the container bottom and the step 35. Further, a location of the retaining element 30 close to the step 35 reduces a distance that the container 10' needs to travel before making impact with the step 35. Thus, a combination of the added force to advance beyond the retaining element 30 and the short distance between the retaining element 20 and the step 35 may result in a "snap" or "pop" sound. The "snap" or "pop" sound may audibly alert the user that the container 10 has reached a final position, and may be safely retained and/or secured within the container holder 101.

Figure 12:
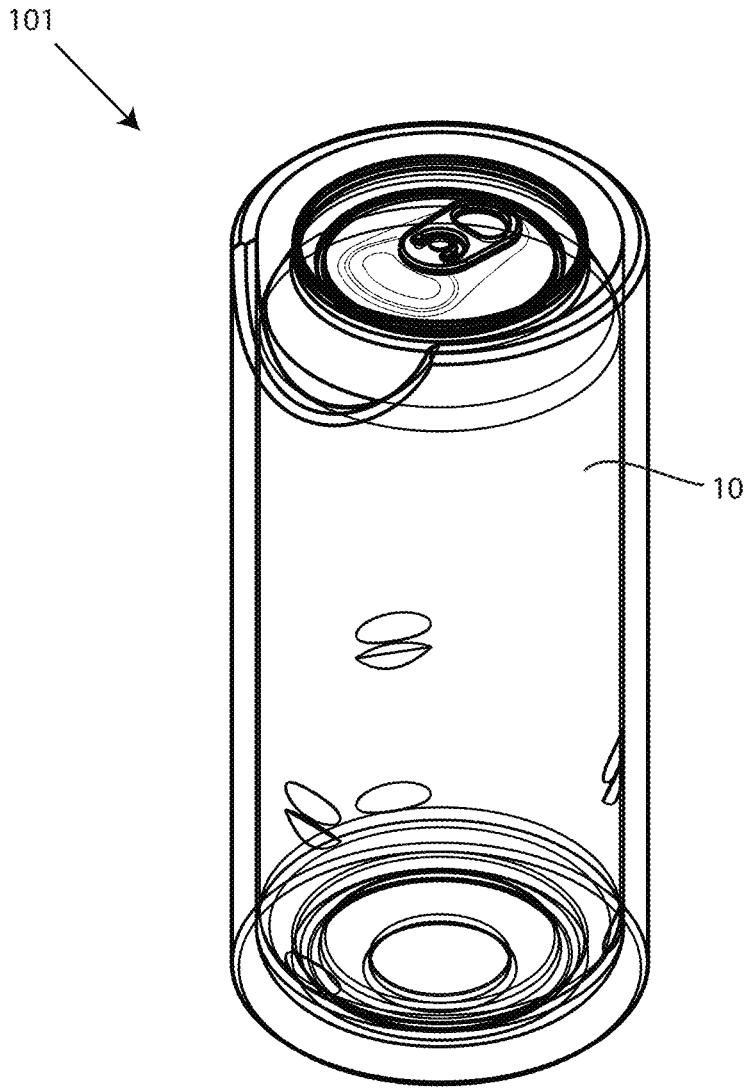
FIG. 12 depicts a perspective, hidden view of a larger container being retained in the container holder, in accordance with embodiments of the present invention.

FIG. 12 depicts a perspective, hidden view of a larger container 10 being retained in the container holder 101, in accordance with embodiments of the present invention. A container 10, which may be taller than the container 10' may also be securely retained within the container holder 101. For instance, a user may simply supply force so that the container 10 passes over the additional retaining structure 30, 35 to engage the retaining element(s) 20 and eventual contact with the bottom surface 6, as described above.

Figure 13:
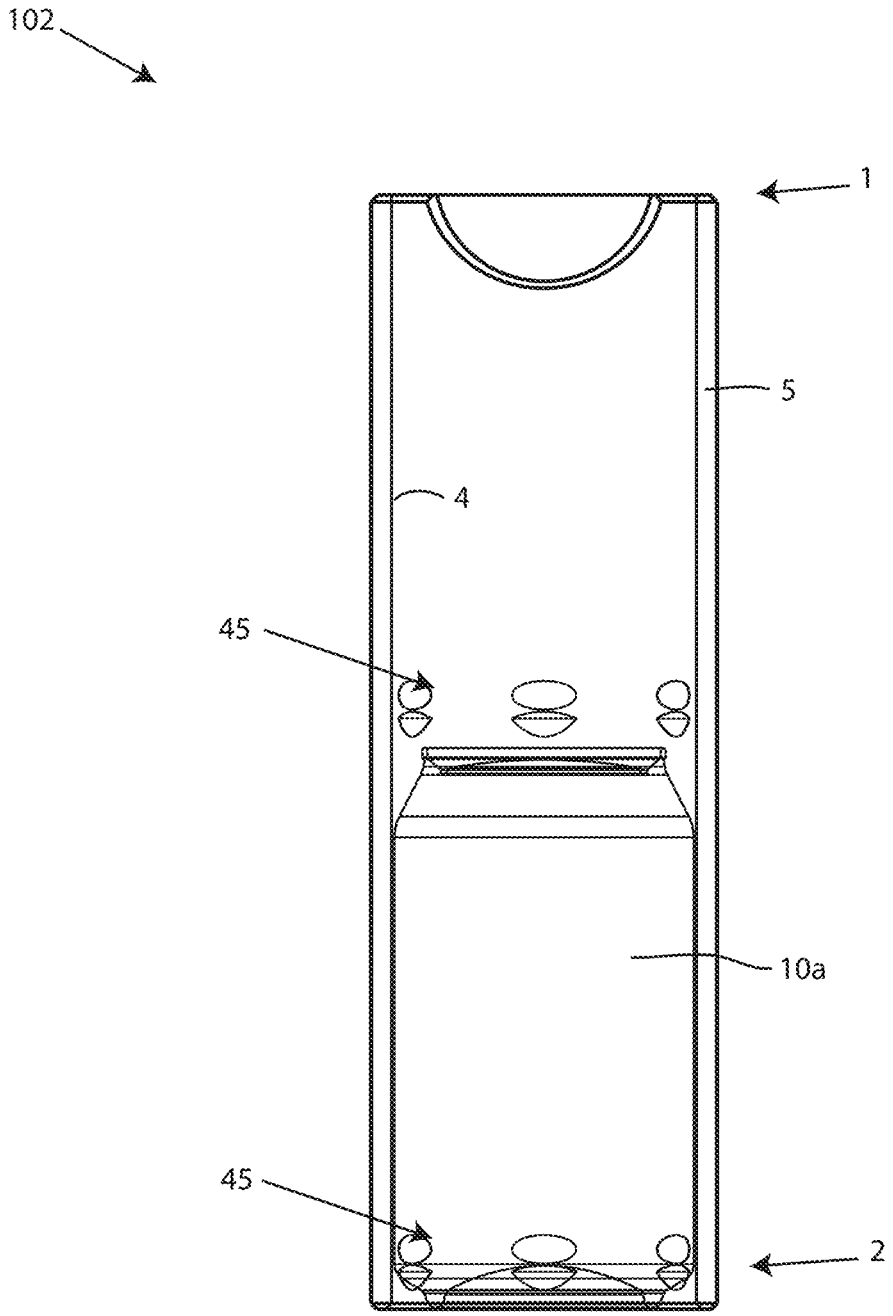
FIG. 13 depicts a container holder with a plurality of sets of retaining structure, having a single container disposed proximate a bottom end, in accordance with embodiments of the present invention.
Figure 14:
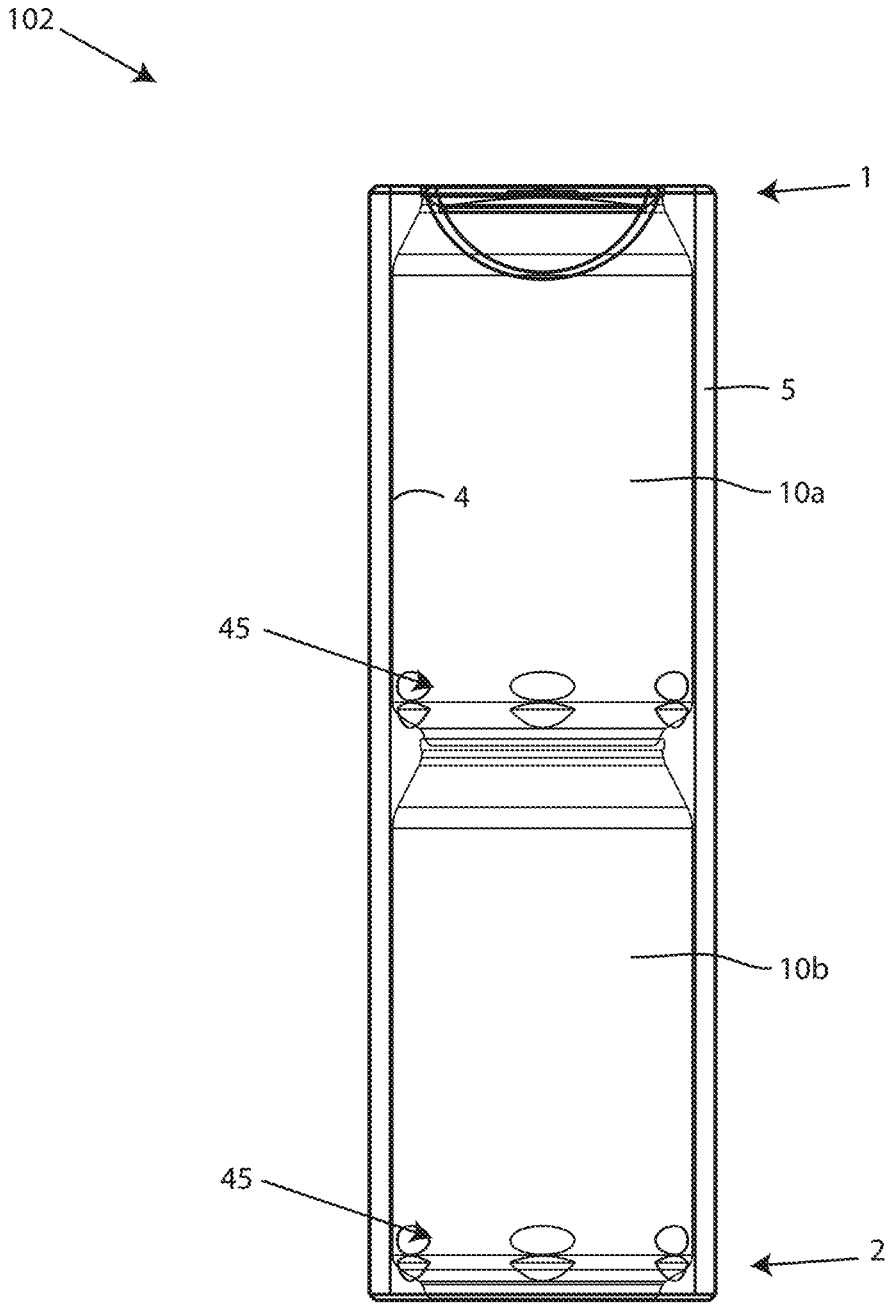
FIG. 14 depicts a container holder with a plurality of sets of retaining structure, having two containers disposed within the container holder, in accordance with embodiments of the present invention.
Figure 15:
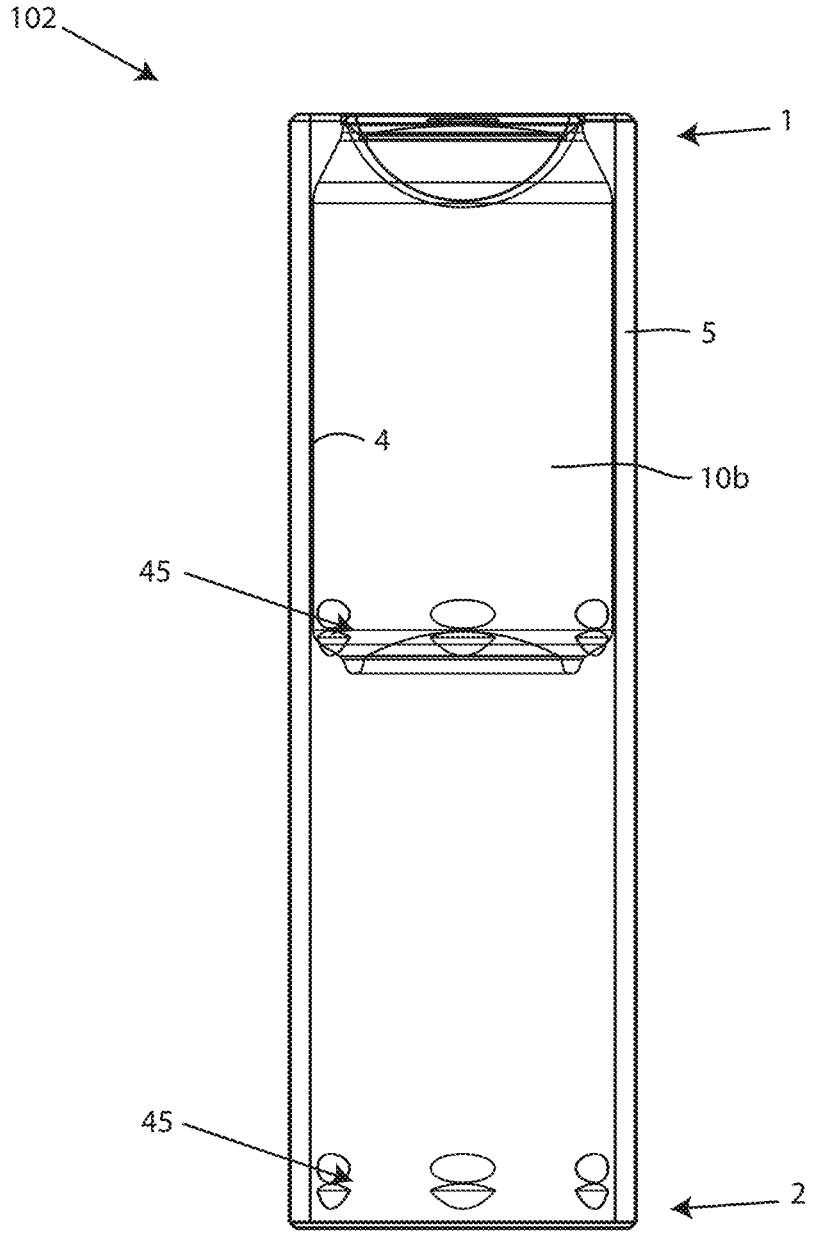
FIG. 15 depicts a container holder having a single container in a top position within the container holder, in accordance with embodiments of the present invention.

In further embodiments, the container holder may hold more than one container therein. FIGS. 13-15 depicts a container holder 102 configured to hold, retain, receive, accommodate, etc. a plurality of containers 10. Embodiments of the container holder 102 may share the same or substantially the same structural features of the container holder 100, but may include a plurality of sets of retaining structure 45, and an open bottom end allowing a passage of a container from the second, bottom end 2 as well as the first, top end 1. A set of retaining structure 45 may be one or more retaining elements 30 and steps 35, as described above, or may be the retaining element 20, or a combination of retaining element 20, retaining element 30, and step 35. The set of retaining structure 45 may be a single retaining structure, or may be a plurality of retaining structures. In an exemplary embodiment, the set of retaining structure 45 may be circumferentially disposed along an inner surface 4 of the container holder 102. For instance, embodiments of the set of retaining structure 45 may be disposed at various circumferential locations around the body portion 5, yet may share a same axial distance from ends 1, 2. For example, embodiments of the container holder 102 may include a first set of retaining structure 45 disposed along an inner surface of the container holder 102 at a first distance from a first end 1, and a second set of retaining structure 45 at a second distance from the first end 1 of the container holder 102. The distance between the first set of retaining structure 45 and the second set of retaining structure 45 may correspond to a height or shape of a container 10 to be inserted therein.

Embodiments of the container holder 102 may include more than two sets of retaining structure 45; the holder 102 may include three sets, four sets, five sets, six sets, seven sets, eight sets, n-sets, wherein a total length of the container holder 102. For example, embodiments of the container holder 102 may include six sets of retaining structure 45 to accommodate six containers. In this exemplary embodiment, a six-pack of beer or other beverage may be accommodated by the container holder 102. The container holder 102 may be pre-packaged with a number of containers 10 (e.g. 2-6+) from a distributor for purchase by a consumer. Thus, the container holder 102 may be used as a portable carrying device for a plurality of containers 10.

Furthermore, the open bottom of the container holder 102 and the plurality of sets of retaining structure 45 may facilitate both storing containers 10 as well as a swapping out of used/expired containers 10 with new, unopened, or non-expired containers 10. FIG. 13 depicts a container holder 102 with a plurality of sets of retaining structure 45, having a single container 10*a* disposed proximate a bottom end 2, in accordance with embodiments of the present invention. In FIG. 13, a top portion of the interior region of the container holder 102 does not have a container (e.g. a container was used/spent and thus removed by the user). The container 10*a* disposed therein proximate the bottom may have been stored therein, taking advantage of the insulating properties of the container holder 102. To displace the container 10*a* from the bottom portion to the top portion for convenient consumption or access to the container 10*a*, an additional container 10*b* may be inserted through the bottom end 2 to drive the container 10*a* to the top position within the beverage container 102. FIG. 14 depicts a container holder 102 with a plurality of sets of retaining structure 45, having two containers 10*a*, 10*b* disposed within the container holder 102, in accordance with embodiments of the present invention. To insert the additional container 10*b* into the container holder 102 to drive the container 10*a* into a top position, the container holder 102 may be placed over the additional container 10*b*, which may be set on a table or other hard surface, and then lowered onto and over the additional container 10*b*. In this way, a user does not need to manually insert the additional container 10*b* into the container holder 102, although manual insertion is possible. This applies to a container holder 102 configured to hold two containers, such as container 10*a*, 10*b*, as well as to a container holder 102 configured to hold more than two containers, wherein intermediate containers act as driver to an adjacent container.

FIG. 15 depicts a container holder 102 having a single container 10*b* in a top position within the container holder 102, in accordance with embodiments of the present invention. As shown in FIG. 15, a single container 10*b* may be retained in a top position without another container positioned below, due to a first set of retaining structure 45 proximate a top end 1 of the container holder 102.

Referring now to FIGS. 1-15, a method of securely retaining a container 10, 10' will now be described. A method for securely retaining a container within a thermally insulated holder may include disposing at least one retaining element 20 along an inner surface 4 of a cylindrical body portion 5, wherein the at least one retaining element 20 is located at least one of: proximate a bottom surface 6 a top surface, a center section of the body portion 5, or along the inner surface between the first end 1 and the second end 2, wherein the location of the at least one retaining element 20 with respect to the bottom surface 6 creates a sound effect when a container 10 moves from an initial contact with the at least one retaining element 20 to a final, retained position of engagement.

While this disclosure has been described in conjunction with the specific embodiments outlined above, it is evident that many alternatives, modifications and variations will be apparent to those skilled in the art. Accordingly, the preferred embodiments of the present disclosure as set forth above are intended to be illustrative, not limiting. Various changes may be made without departing from the spirit and scope of the invention, as required by the following claims. The claims provide the scope of the coverage of the invention and should not be limited to the specific examples provided herein.

What is claimed is:

1. A container holder comprising:

a body portion having a first end, a second end, an inner surface that extends between the first end and the second end, and an outer surface, wherein an interior region of the body portion is defined as a generally cylindrical axial opening between the first end and the second end;

at least one retaining element inwardly protruding from the inner surface of the body portion into the generally cylindrical axial opening, wherein the at least one retaining element is configured to accommodate a container and to exert a force against the container to retain the container within the generally cylindrical axial opening;

an additional retaining structure disposed along the inner surface of the body portion at a different axial location than the at least one retaining element; and an opening in a bottom surface of the body portion that is sized to allow access of a finger of a user into the interior region of the container holder to disengage the container from a retained position within the container holder;

wherein a gap is present between the at least one retaining element and the bottom surface.

2. The container holder of claim 1, wherein, when the body portion is inverted, the container inserted into the container holder remains retained within the generally cylindrical axial opening due to a mechanical interference between a side wall portion of the container and the at least one retaining element.

3. The container holder of claim 1, wherein the at least one retaining element includes a plurality of protrusions circumferentially disposed along the inner surface of the body portion, all at a same distance from the bottom surface.

4. The container holder of claim 1, wherein, when the container is located within the container holder, the additional retaining structure is configured to exert a force against the container at a different location than a location of the force exerted onto the container by the at least one retaining element.

5. The container holder of claim 1, wherein a snapping sound is generated when the beverage container moves from a hindered position to a final retained position.

6. The container holder of claim 1, wherein a top edge of the container is flush with a top edge of the body portion, when in the retained position.

7. The container holder of claim 1, wherein the body portion is comprised of a thermally insulated material.

8. The container holder of claim 1, wherein the at least one retaining element is located proximate the bottom surface of the body portion.

9. The container holder of claim 1, wherein the additional retaining structure includes a retaining element and a step.

10. The container holder of claim 1, wherein the additional retaining structure accommodates a container of a second length that is shorter than the first length, wherein the additional retaining structure is configured to exert a force against the container of the second length so that at least a majority of the container of the second length is securely retained within the generally axial opening and suspended above the at least one retaining element.

11. An apparatus comprising:

a first beverage container holder comprising a first cylindrical body portion having a first end, a second end, an inner surface that extends between the first end and the second end, and an outer surface, wherein an interior region of the first cylindrical body portion is defined as a generally cylindrical axial opening between the first end and the second end, at least one retaining element inwardly protruding from the inner surface of the body portion into the generally cylindrical axial opening, wherein the at least one retaining element is located proximate a bottom surface of the first cylindrical body portion, an additional retaining structure disposed along the inner surface of the body portion at a different axial location than the at least one retaining element, and an opening in the bottom surface of the first cylindrical body portion that is sized to allow access of a finger of a user into the interior region of the container holder to disengage the container from a retained position within the container holder; and a second beverage container holder invertedly attached to the first beverage container holder, the second beverage container holder comprising a second cylindrical body portion having a first end, a second end, an inner surface that extends between the first end and the second end, and an outer surface, wherein an interior region of the second cylindrical body portion is defined as a generally axial opening between the first end and the second end, at least one retaining element disposed along the inner surface of the second cylindrical body portion, wherein the at least one retaining element is located proximate a bottom surface of the second cylindrical body portion, and an opening in a bottom surface of the second cylindrical body portion that is sized to allow access of a finger of a user into the interior region of the container holder to disengage the container from a retained position within the container holder, wherein a gap is present between the at least one retaining element and the bottom surface.

12. The apparatus of claim 11, wherein a first beverage container is configured to be received within the first beverage container holder, and a second beverage container is configured to be received in the second beverage container holder.

13. The apparatus of claim 12, wherein the second beverage container is inverted and remains retained within the second beverage container holder when the first beverage container holder is in an upright position.

14. The apparatus of claim 11, wherein the first beverage container holder and the second beverage container holder are comprised of a thermally insulating material.

15. A method for securely retaining a container within a thermally insulated holder, comprising:

disposing at least one retaining element along an inner surface of a body portion, the at least one retaining element inwardly protruding from the inner surface of the body portion into a generally cylindrical axial opening defined by the inner surface of the body portion, wherein the inner surface extends between a first end and a second end of the body portion;

disposing an additional retaining structure along the inner surface of the body portion at a different axial location than the at least one retaining element, wherein the additional retaining structure exerts a force against the container to securely retain the container within the generally cylindrical axial opening, suspending the container above the at least one retaining element until an external force is applied to the container to advance past the additional retaining structure towards the at least one retaining element located proximate a bottom surface of the thermally insulated holder; and disposing an opening in a bottom surface of the body portion that is sized to allow access of a finger of a user into the interior region of the container holder to disengage the container from a retained position within the container holder;

wherein a gap is present between the at least one retaining element and the bottom surface;

wherein an audible sound is generated when the container moves from an initial contact with the at least one retaining element to a final, retained position of engagement.

16. The method of claim 15, wherein the audible sound is a pop, a snap, a crack, or a knock, that signifies a limit of insertion.

17. The method of claim 15, wherein the body portion is a cylindrical body portion, and the container is a beverage container.

* * * * *